US007810354B2

(12) United States Patent
Mpasiakos

(10) Patent No.: US 7,810,354 B2
(45) Date of Patent: Oct. 12, 2010

(54) MULTI-PIECE PUZZLE CHARM

(76) Inventor: Cindy Mpasiakos, 16 Willard Pl., Monroe, NY (US) 10950

( * ) Notice: Subject to any disclaimer, the term of this patent is extended or adjusted under 35 U.S.C. 154(b) by 508 days.

(21) Appl. No.: 11/903,242

(22) Filed: Sep. 21, 2007

(65) Prior Publication Data

US 2009/0078002 A1 Mar. 26, 2009

(51) Int. Cl.
*A44C 25/00* (2006.01)
*A63F 9/10* (2006.01)

(52) U.S. Cl. ..... 63/23; 63/1.16; 63/41; 273/157 R

(58) Field of Classification Search ..... None
See application file for complete search history.

(56) References Cited

U.S. PATENT DOCUMENTS 1,371,932 A * 3/1921 Przybyla ..... 63/21
6,145,341 A * 11/2000 Leong ..... 63/1.11
2004/0123500 A1* 7/2004 Lau ..... 40/124.01

* cited by examiner

*Primary Examiner*—Jack W. Lavinder
(74) *Attorney, Agent, or Firm*—Robert P. Michal, Esq.; Lucas & Mercanti, LLP

(57) ABSTRACT

Multi-piece charm includes at least one edge puzzle piece charm each having at least one smooth edge and at least one edge having at least one tab or blank, and at least one additional puzzle piece charm having a tab or blank and arranged to interlock with an edge puzzle piece charm. Each puzzle piece charm includes an aperture to enable a strand of material to be passed therethrough and enable the puzzle piece charms to be worn on a part of the body. The additional puzzle piece charm may be another edge puzzle piece or a middle puzzle piece charm which has one or more tabs or blanks, either on a single edge, on a plurality of edges or on all of its edges.

17 Claims, 1 Drawing Sheet

MULTI-PIECE PUZZLE CHARM

FIELD OF THE INVENTION

The present invention relates generally to a multi-piece puzzle charm having a plurality of interlocking puzzle pieces whereby each piece is able to be used as a charm.

BACKGROUND OF THE INVENTION

Charms are quite common and are typically provided with a aperture through which a bracelet, necklace, rope or other strand of material is passed so that the charm is worn when the bracelet, necklace, rope or other strand of material is placed around a body part.

There are existing charms in the shape of conventional, individual puzzle pieces, e.g., a single puzzle piece having four sides with a blank or a tab formed on each side.

There are also known multi-piece charms formed from a pair of interlocking puzzle piece charms which interlock on one side, i.e., the tab on one side of one puzzle piece charm fits into the blank on one side of the other puzzle piece charm. Some such puzzle piece charms include the notation "best friends", and thus would be used by two best friends whereby each best friend wears one of the puzzle piece charms. Each of these puzzle piece charms is in the shape of an individual puzzle piece and thus includes four sides with a tab or blank formed on each side.

Additionally, some multi-piece charms are formed from multiple charms which can be placed together to form a single shape, e.g., a heart or a circle. However, the charms are not in the form of individual puzzle pieces and are separated by a straight or jagged line.

OBJECTS AND SUMMARY OF THE INVENTION

It is an object of the present invention to provide a new and improved multi-piece puzzle charm.

In order to achieve this object and possibly others, one embodiment of a multi-piece charm in accordance with the invention includes at least one edge puzzle piece charm each having at least one smooth edge and at least one edge having at least one tab or blank, and at least one additional puzzle piece charm having a tab or blank and arranged to interlock with an edge puzzle piece charm. Each puzzle piece charm includes an aperture to enable a strand of material to be passed therethrough and enable the puzzle piece charms to be worn on a part of the body. The aperture may be defined by a ring or other annular form extending or projecting outward from an edge of the puzzle piece charm, and which may be formed separate from and then attached to the body of the puzzle piece charm.

In one embodiment, the additional puzzle piece charm is a middle puzzle piece charm which has one or more tabs or blanks, either on a single edge, on a plurality of edges or on all of its edges.

Various combinations of edge puzzle pieces and middle puzzle pieces as described above are envisioned, including but not limited to a multi-piece charm with one edge puzzle piece charm and one middle puzzle piece charm, a multi-piece puzzle charm with two or more edge puzzle piece charms and no middle puzzle piece charms, and a multi-piece puzzle charm with two or more edge puzzle piece charms and one or more middle puzzle piece charms.

In one particular embodiment, the multi-piece charm includes five edge puzzle piece charms and a single middle puzzle piece charm and has the shape of a heart when the puzzle piece charms are interlocking.

Other and further objects, advantages and features of the present invention will be understood by reference to the following specification in conjunction with the annexed drawings, wherein like parts have been given like numbers.

BRIEF DESCRIPTION OF THE DRAWINGS

The invention, together with further objects and advantages thereof, may best be understood by reference to the following description taken in conjunction with the accompanying drawings, wherein like reference numerals identify like elements, and wherein.

DETAILED DESCRIPTION OF THE INVENTION

Figure 1:
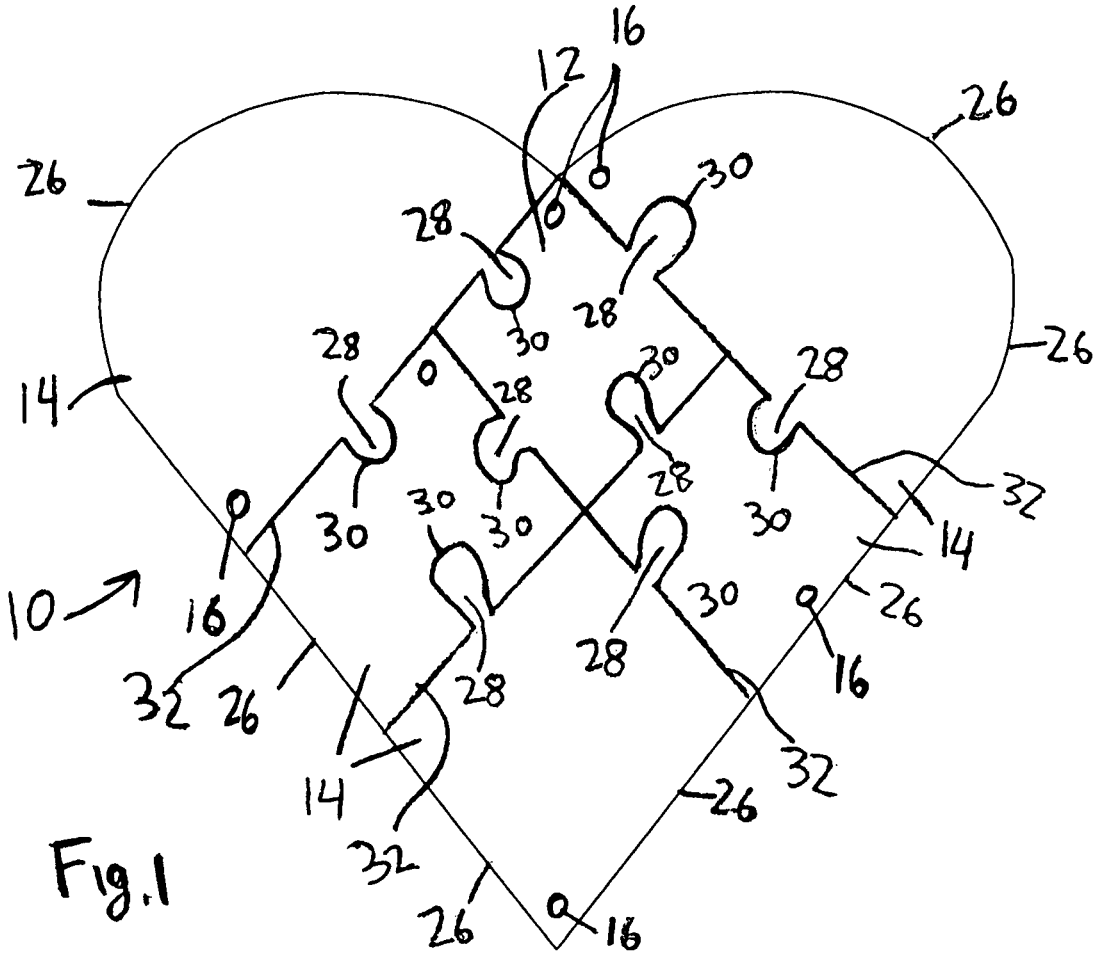
FIG. 1 is a perspective view of an exemplifying embodiment of a multi-piece charm in accordance with the invention.
Figure 2:
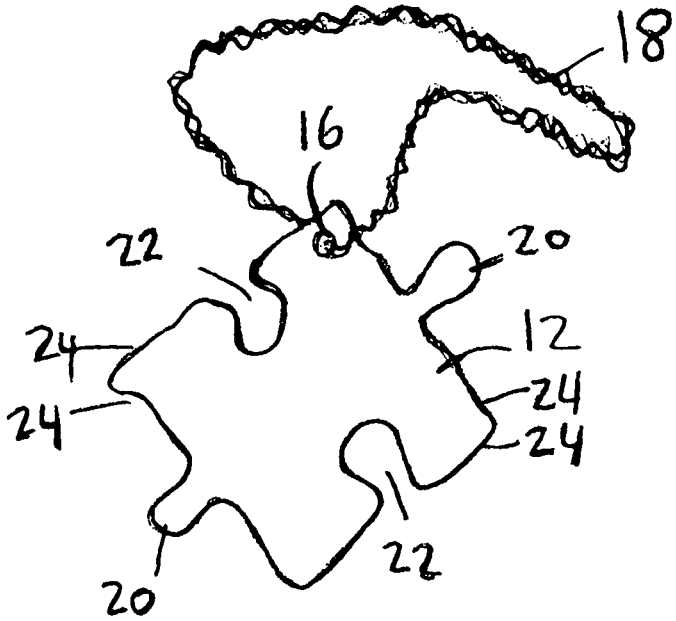
FIG. 2 is a view of one of the puzzle piece charms of the multi-piece charm shown in FIG. 1 attached to a strand of material.

Referring to the accompanying drawings wherein like reference numerals refer to the same or similar elements, a multi-piece charm in accordance with the invention is designated generally as 10 and is formed from a plurality of individual puzzle piece charms 12, 14. Each puzzle piece charm 12, 14 includes an aperture 16 through which a chain, rope or other type of strand of material 18 can be passed to enable the puzzle piece charms 12, 14 to be worn, carried on chains, belts or bags, or otherwise used (see FIG. 2). Aperture 16 may be formed in the main body portion of the puzzle piece charms 12, 14 as shown or a ring may be formed or attached to an edge of the puzzle piece charm 12, 14 and define the aperture 16. As shown in FIG. 1, puzzle piece charms 12, 14 have major surfaces, i.e., a front major surface and a rear major surface opposite the front major surface, and the apertures 16 extend through the opposed major surfaces. Thus, as shown in FIG. 1, when the puzzle piece charms 12, 14 are interlocked via interlocking edges that extend between sides of the major surfaces, described below, the major surfaces and the apertures 16 therein are visible.

In the illustrated embodiment of the invention, there are two different types of puzzle piece charms 12, 14 which are used in combination to form the multi-piece charm 10. Specifically, one type is a middle puzzle piece charm 12 which includes a tab 20 or blank 22 on all of its edges 24, i.e., on all four of its sides in view of its rectangular shape (see FIG. 2). The other type is an edge puzzle piece charm 14 which includes one or more smooth edges 26 and a tab 28 or blank 30 on one or more of its edges 32 which face other puzzle piece charms 12, 14. Smooth edges 26 are smooth in the sense that they are linear and typical for the edge pieces of puzzles. It is also possible that one edge 32 of an edge puzzle piece charm 14 which faces another puzzle piece charm 12, 14 includes a plurality of tabs and/or blanks, e.g., one tab and one blank, two tabs or two blanks.

Of the edge puzzle piece charms 14, some include a single smooth edge 26 and a single edge having a plurality of tabs 28 or blanks 30, while others include a single smooth edge 26 and a plurality of edges each having a tab 28 or blank 30. Another edge puzzle piece charm 14 has a plurality of smooth edges and a plurality of edges each having a tab 28 or blank 30.

The tabs 20, 28 and blanks 22, 30 are formed to interlock with one another. Each tab 20, 28 as used herein is formed as a projection from an otherwise substantially straight edge whereas each blank 22, 30 is formed as a recess from an otherwise substantially straight edge, with the projection and recess being formed to provide a secure, locking fit when interlocking. Each tab 20, 28 may be formed with a smaller transverse dimension adjacent the edge from which it projects and then expand to have a larger transverse dimension. Similarly, each blank 22, 30 may be formed to have a smaller transverse dimension adjacent the edge from which it recesses and then expand to have a larger transverse dimension. Instead of tabs 20, 28 and blanks 22, 30, other forms of interlocking structure can be used in accordance with the invention.

The edges 26 of the edge puzzle piece charms 14 are smooth in the sense that they do not include any projecting tabs or recessed blanks or other interlocking structure, and thus cannot be attached along these edges 26 to another puzzle piece charm.

As shown, multi-piece charm 10 includes five edge puzzle piece charms 14 and a single middle puzzle piece charm 12. However, in some embodiments, the multi-piece charm can include only edge puzzle piece charms 14, or a single edge puzzle piece charm 14 and one or more middle puzzle piece charms 12, or a plurality of edge puzzle piece charms 14 and a plurality of middle puzzle piece charms 12.

The multi-piece charm 10 can be designed to have a specific shape, e.g., a heart shape as shown. Other shapes are also envisioned. Whatever shape is used, a substrate sufficiently large enough to form a plurality of charms having a desired size would be formed into that shape, with its outer edges smooth and lacking any tabs or blanks or other interlocking structure. The substrate would then be partitioned into the individual puzzle piece charms, including at least one edge puzzle piece charm 14 and at least one other puzzle piece charm, whether a middle puzzle piece charm 12 or another edge puzzle piece charm 14. Apertures 16 are formed in each puzzle piece charm 12, 14 to enable each puzzle piece charm 12, 14 to be used independently of one another, i.e., either by forming a hole in the body of the puzzle piece charm 12, 14 or attaching a ring to an edge of the puzzle piece charm 12, 14.

An alternative fabrication method may involve use of a mold of each puzzle piece charm, with the molds being formed to enable the puzzle piece charms to interlock with one another.

The puzzle piece charms 12, 14 may be formed from any suitable material for a charm, including but not limited to silver, gold, silver alloys, gold alloys, silver-plated materials, and gold-plated materials. The strand of material 18 passed through the apertures 16 in the puzzle piece charms 12, 14 may be made of any suitable material, including but not limited to silver, gold and other metals.

In one embodiment, each puzzle piece charm 12, 14 may be customized, e.g., provided with a birthstone thereon or engraved with an initial.

While particular embodiments of the invention have been shown and described, it will be obvious to those skilled in the art that changes and modifications may be made without departing from the invention in its broader aspects, and, therefore, the aim of this application is to cover all such changes and modifications as fall within the true spirit and scope of the invention.

The invention claimed is:

1. A multi-piece charm, comprising:

at least one edge puzzle piece charm each having at least one smooth, linear edge and at least one interlocking edge, each of said at least one interlocking edge having at least one tab the projects from a remaining portion of said interlocking edge or a blank that is recessed inward of a remaining portion of said interlocking edge, each of said at least one edge puzzle pieces having opposed major surfaces, said at least one smooth edge and said at least one interlocking edge being arranged at sides of said major surfaces and extending between said major surfaces; and at least one additional puzzle piece charm having major surfaces and at least one interlocking edge arranged at sides of said major surfaces and extending between said major surfaces, each of said at least one interlocking edge having a tab that projects from a remaining portion of said interlocking edge or a blank that is recessed inward of a remaining portion of said interlocking edge, said at least one additional puzzle piece charm being arranged to interlock with said at least one edge puzzle piece charm via said at least one tab or blank on said at least one interlocking edge of said at least one edge puzzle piece, said puzzle piece charms each including an aperture extending through said major surfaces such that when said at least one edge puzzle piece charm and said at least one additional puzzle piece charm are interlocked via said at least one interlocking edge of said at least one edge puzzle piece charm and said at least one interlocking edge of said at least one additional puzzle piece charm, said major surfaces of said puzzle piece charms and said apertures therein are visible, whereby a strand of material can be passed through the aperture of each of said puzzle piece charms to enable said puzzle piece charms to be worn.

2. The multi-piece charm of claim 1, wherein said at least one edge puzzle piece charm comprises a plurality of edge puzzle piece charms.

3. The multi-piece charm of claim 1, wherein said at least one additional puzzle piece charm is a middle puzzle piece charm having a plurality of tabs or blanks on any of its edges facing said at least one edge puzzle piece charm.

4. The multi-piece charm of claim 3, wherein said middle puzzle piece charm comprises a plurality of edges facing said at least one edge puzzle piece charm and has at least one tab or blank on each of said edges.

5. The multi-piece charm of claim 1, wherein said at least one additional puzzle piece charm comprises at least one additional edge puzzle piece charm and a middle puzzle piece charm having a tab or blank on all of its edges facing said edge puzzle piece charms.

6. The multi-piece charm of claim 1, wherein said puzzle piece charms are arranged to have a heart shape when interlocking.

7. The multi-piece charm of claim 1, wherein said at least one edge puzzle piece charm has only a single smooth edge and a single edge having at least one tab or blank.

8. The multi-piece charm of claim 1, wherein said at least one edge puzzle piece charm has a single smooth edge and a plurality of edges each having at least one tab or blank.

9. The multi-piece charm of claim 1, wherein said at least one edge puzzle piece charm has only a single smooth edge and a single edge having a plurality of tabs or blanks.

10. The multi-piece charm of claim 1, wherein said at least one edge puzzle piece charm has a plurality of smooth edges.

11. A multi-piece charm, comprising:

a plurality of edge puzzle piece charms each having at least one smooth, linear edge and at least one interlocking edge, each of said at least one interlocking edge having at least one tab that projects from a remaining portion of said interlocking edge or a blank that is recessed inward of a remaining portion of said interlocking edge, each of said edge puzzle piece charms having opposed major surfaces, said at least one smooth edge and said at least one interlocking edge being arranged at sides of said major surfaces and extending between said major surfaces; and at least one middle puzzle piece charm, each having major surfaces and a plurality of interlocking edges arranged at sides of said major surfaces and extending between said major surfaces, each of said interlocking edges having a tab that projects from a remaining portion of said interlocking edge or a blank that is recessed inward of a remaining portion of said interlocking edge, said at least one middle puzzle piece charm being arranged to interlock with said edge puzzle piece charms via said at least one tab or blank on said at least one edge of said edge puzzle pieces, said edge and middle puzzle piece charms each including an aperture extending through said major surfaces such that when said edge and middle puzzle piece charms are interlocked via said interlocking edges, said major surfaces of said edge and middle puzzle piece charms and said apertures therein are visible, whereby a strand of material can be passed through the aperture of each of said edge and middle puzzle piece charms to enable said edge and middle puzzle piece charms to be worn.

12. The multi-piece charm of claim 11, wherein each of said at least one middle puzzle piece charm comprises a plurality of edges and has at least one tab or blank on each of said edges.

13. The multi-piece charm of claim 11, wherein said puzzle piece charms are arranged to have a heart shape when interlocking.

14. The multi-piece charm of claim 11, wherein at least one of said edge puzzle piece charms has only a single smooth edge and a single edge having at least one tab or blank.

15. The multi-piece charm of claim 11, wherein at least one of said edge puzzle piece charms has a single smooth edge and a plurality of edges each having at least one tab or blank.

16. The multi-piece charm of claim 11, wherein at least one of said edge puzzle piece charms has only a single smooth edge and a single edge having a plurality of tabs or blanks.

17. The multi-piece charm of claim 11, wherein at least one of said edge puzzle piece charms has a plurality of smooth edges.

* * * * *